US010064492B2

(12) United States Patent
Lobel

(10) Patent No.: US 10,064,492 B2
(45) Date of Patent: Sep. 4, 2018

(54) REMOVABLE SEAT CUSHION AND METHOD

(71) Applicant: Scott Lobel, Atlanta, GA (US)

(72) Inventor: Scott Lobel, Atlanta, GA (US)

( * ) Notice: Subject to any disclaimer, the term of this patent is extended or adjusted under 35 U.S.C. 154(b) by 9 days.

(21) Appl. No.: 15/434,119

(22) Filed: Feb. 16, 2017

(65) Prior Publication Data

US 2017/0245644 A1 Aug. 31, 2017

Related U.S. Application Data

(60) Provisional application No. 62/301,205, filed on Feb. 29, 2016.

(51) Int. Cl.
*A47C 7/02* (2006.01)
*A47C 1/02* (2006.01)
*A47C 31/02* (2006.01)

(52) U.S. Cl.
CPC ..... *A47C 7/021* (2013.01); *A47C 1/02* (2013.01); *A47C 31/023* (2013.01)

(58) Field of Classification Search
CPC ..... A47C 7/021; A47C 1/027; A47C 1/024
See application file for complete search history.

(56) References Cited

U.S. PATENT DOCUMENTS 1,892,913 A * 1/1933 Timm ..... A47C 27/05 5/696
3,220,767 A * 11/1965 Hendrickson ..... A47C 7/021 297/228.12
3,544,160 A * 12/1970 Karasick ..... A47C 1/027 297/354.1
4,179,158 A * 12/1979 Flaum ..... A47C 3/16 297/248
4,336,621 A * 6/1982 Schwartz ..... A47C 27/001 5/411
4,365,840 A * 12/1982 Kehl ..... A47C 4/02 297/232
4,372,606 A * 2/1983 Faull ..... A47C 3/025 297/265.1
5,407,247 A * 4/1995 Forcier ..... A47C 7/021 297/229
5,428,852 A * 7/1995 Tenuta ..... A47C 31/105 5/690
6,163,907 A * 12/2000 Larson ..... A47C 31/105 5/421
6,736,453 B2 * 5/2004 Chambers ..... A47C 31/11 297/228.1
6,929,325 B1 * 8/2005 Goelo ..... A47C 1/16 297/183.5
7,159,940 B1 * 1/2007 Atkins ..... A47C 3/18 297/240
7,396,080 B2 * 7/2008 Suhr ..... A47C 3/026 297/313
8,500,197 B2 * 8/2013 Keyton ..... B60N 2/24 297/224

(Continued)

*Primary Examiner* — Timothy J Brindley
(74) *Attorney, Agent, or Firm* — Steven B. Shipe

(57) ABSTRACT

The present invention includes a removable recliner seat cushion as well as a method for attaching the removable recliner seat cushion to reclining furniture. The removable recliner seat cushion comprises a seat cushion and at least two attaching flaps. The present invention also includes a method for attaching a removable seat recliner set cushion to reclining furniture.

10 Claims, 3 Drawing Sheets

(56) References Cited

U.S. PATENT DOCUMENTS

| | | | | |
|---|---|---|---|---|
| 8,534,755 | B2 * | 9/2013 | Nickerson | A45F 4/02 297/217.1 |
| 9,066,594 | B1 * | 6/2015 | Smith | A47C 4/02 |
| 9,295,339 | B2 * | 3/2016 | Hampton | A47C 31/023 |
| 2005/0225134 | A1 * | 10/2005 | Tseng | A47C 7/021 297/219.1 |
| 2005/0235423 | A1 * | 10/2005 | Hetzel | A47C 7/022 5/653 |
| 2006/0097558 | A1 * | 5/2006 | Aubert | A47C 1/03238 297/344.26 |
| 2010/0026077 | A1 * | 2/2010 | Tarumi | A47C 7/021 297/452.62 |
| 2010/0270844 | A1 * | 10/2010 | Hood | A47C 7/42 297/440.15 |
| 2011/0127816 | A1 * | 6/2011 | Hampton | A47C 31/11 297/229 |
| 2014/0070575 | A1 * | 3/2014 | von Saher | A47C 7/62 297/188.2 |
| 2014/0125098 | A1 * | 5/2014 | Vainberg | A47C 31/116 297/219.1 |
| 2015/0115675 | A1 * | 4/2015 | Winkelman | B68G 5/02 297/228.13 |
| 2015/0123439 | A1 * | 5/2015 | Jordan | A47C 31/113 297/228.1 |
| 2016/0015180 | A1 * | 1/2016 | Ramirez | G09F 23/00 297/188.2 |
| 2016/0353895 | A1 * | 12/2016 | Lakshmi Narasimhan | A47C 7/021 |

* cited by examiner

REMOVABLE SEAT CUSHION AND METHOD

RELATED APPLICATIONS

This application is a non-provisional application of, and claims priority to, U.S. Provisional App. No. 62/301,205 (filed on Feb. 29, 2016).

FIELD OF THE INVENTION

The present invention relates generally to furniture. In particular, the present invention includes a removable recliner seat cushion as well as a method for attaching the removable recliner seat cushion to reclining furniture.

BACKGROUND OF THE INVENTION

Recliners, which are also known as reclining chairs or loungers, have been manufactured by the furniture industry for many years.

Recliners are seats which lower the back, neck, and head from an upright position into a reclined position while also raising the feet, by means of a foot rest included as a part of the recliner, in a simultaneous mechanical process. Recliners can be activated either manually through the use of a release lever, or with a controlled motorized drive shaft working in conjunction with the reclining mechanism.

Recliners are great improvements over similar stationary chairs. However, as typically manufactured, these devices have their limitations. For example, recliner seat cushions need to be attached to the frame of the seat or to other portions of the recliner so that the cushion does not shift while the reclining mechanism is operating; not only might this shift affect the user's comfort, it may also prevent the footrest from properly opening and closing. This also makes it difficult to clean the seat cushions and the areas between the seat cushions and other cushions (such as the back or side cushions) on the recliner.

Furthermore, most recliner seats utilize cushions containing a core insert (typically comprised of foam, down, or springs) that wear or lose their shape over time. Because the recliner seat cushions needs to be attached to other portions of the recliner, this makes it difficult and expensive to replace this core insert, as replacing the core insert would involve upholstery work.

As such, there is a need for a new and improved recliner seat cushion that is affixed, yet removable, and a method for attaching the removable seat cushion to the recliner.

SUMMARY OF THE INVENTION

The present invention solves this need and other problems related to recliner seats.

The present invention relates to a recliner seat cushion that is affixed to other portions of the recliner, and yet removable.

Embodiments of the invention include a recliner seat cushion for which two flaps are sewn on to the underside of the cushion, with the flaps attached to the lower front and lower back of the cushion. The flaps include a strip of loop—part of a hook-and-loop fastener—sewn on to the edge of the flap that is furthest from the cushion. Strips of hook—other parts of a hook-and-loop fastener—are affixed to the underside of the front and rear of the seat box or frame of the reclining seat.

Additional embodiments of the invention include a recliner seat cushion that includes a means, including an opening for withdrawing the core insert from the cushion cover so as to permit the installation of a replacement core insert.

Further embodiments of the invention include a method for attaching the removable recliner seat cushion to the other portions of the recliner, in accordance with the invention.

Further features and advantages are apparent from the following detailed description taken in combination with the drawings attached hereto, it being understood that changes may be made in the form, size, proportions, and minor details of construction without departing from the spirit of the invention. This summary is not an intended to be an extensive overview or intended to identify the scope of the invention.

BRIEF DESCRIPTION OF THE DRAWINGS

Further features and advantages are apparent from the following detailed description, taken in combination with the attached figures, wherein.

DETAILED DESCRIPTION

Figure 1:
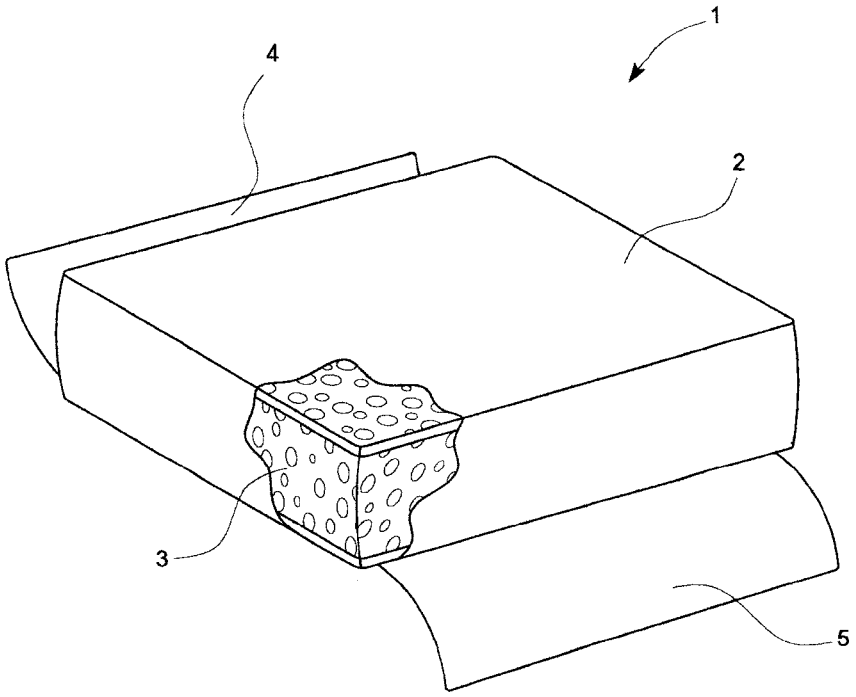
FIG. 1 is an axonometric top view of the recliner seat cushion in accordance with the present invention.

This Detailed Description merely describes exemplary embodiments in accordance with the general inventive concepts and is not intended to limit the scope of the invention in any way. In fact, the invention described in the specification is broader than and unlimited by the exemplary embodiments set forth herein, and all terms used herein have their full and ordinary meaning. The general inventive concept may be embodied in different forms and should not be construed as limited to the embodiments set forth herein. Rather, these embodiments are provided so that this disclosure will be through and will convey the scope of the general inventive concepts to those skilled in the art. The terminology set forth in this Description is for describing particular embodiments only and is not intended to be limiting of the general inventive concepts. Moreover, singular forms, such as "a," "an," and "the" are intended to include the plural forms as well, unless the context clearly indicates otherwise.

A removal seat cushion and method in accordance with the present invention is shown in the drawings and generally designated.

Figure 2:
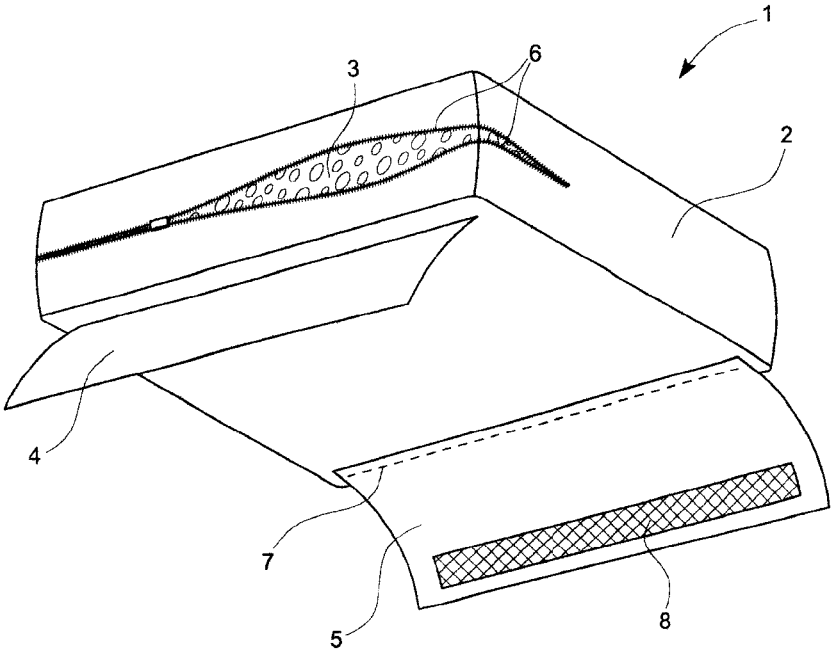
FIG. 2 is an axonometric bottom view of the recliner seat cushion in accordance with the present invention.

FIG. 1 and FIG. 2 illustrate a removable seat cushion 1. A removable seat cushion 1 comprises a seat cover 2, a core insert 3, a rear flap 4, a front flap 5, and a means of attaching the seat cushion to the seat box, frame, or other portion of the recliner. The seat cover 2 could be made of cloth, leather, or any other similar material capable of encasing a core insert 3. The core insert 3 could be made of foam rubber, polyurethane upholstery foam, down, sponge, or any other similar cushion or upholstery fill.

As shown in FIG. 2, the rear flap 4 and the front flap 5 may be attached to the cushion cover 2 via stitching 7 or other means; however, other embodiments of the invention may include other methods for attaching the flaps to the seat cover 2, and it would also still be within the scope of the present invention for the flaps to be fully integrated into, and extend from, the lower portion of the seat cover 2. The flaps could be made of cloth, leather, or any other similar material. As also shown in FIG. 2, the flaps might include strips of loop 8 (as part of a hook-and-loop fastener which is sewn on to the edge of the flap that is furthest from the cushion) or other similar means of attaching the flaps to the seat box, frame, or other portion of the recliner. In the present example, at least two strips of hook (the other part of hook-and-loop fastener) would be affixed to the underside of a seat box or frame of a reclining seat, and the strips of loop (which are attached to the bottom of both flaps) would attach to the strip of hook; however, in other embodiments of the invention, the means of attaching the rear flap 4 and front flap 5 to the seat box, frame, or other portion of the recliner may include any other means that would allow removing the removable seat cushion from the other portions of the recliner.

An additional embodiment is reflected in FIG. 2. In this embodiment, the back panel of the cushion cover 2 includes an opening 6, which is a means for withdrawing the core insert 3 from the cushion cover 2 so as to permit the installation of a replacement core insert. The depicted opening 6 includes a zipper; however, it would be within the scope of the current invention for the opening 6 to constitute buttons, snaps, extra folds of material, or any other apparatus that would allow a core insert 3 to be removed from the cushion cover 2.

Figure 3:
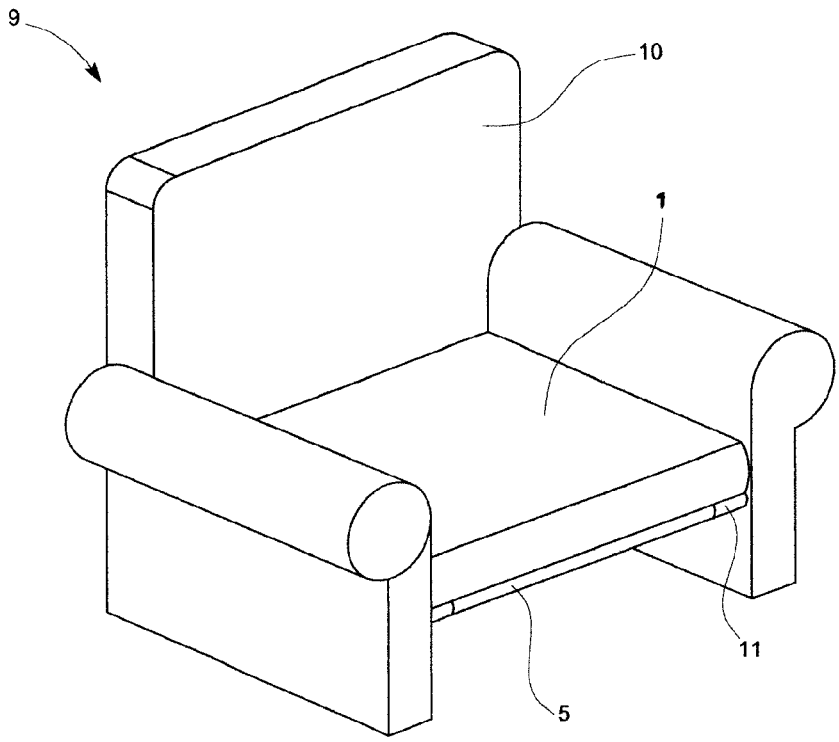
FIG. 3 is an axonometric top view of a recliner in accordance with the present invention.
Figure 4:
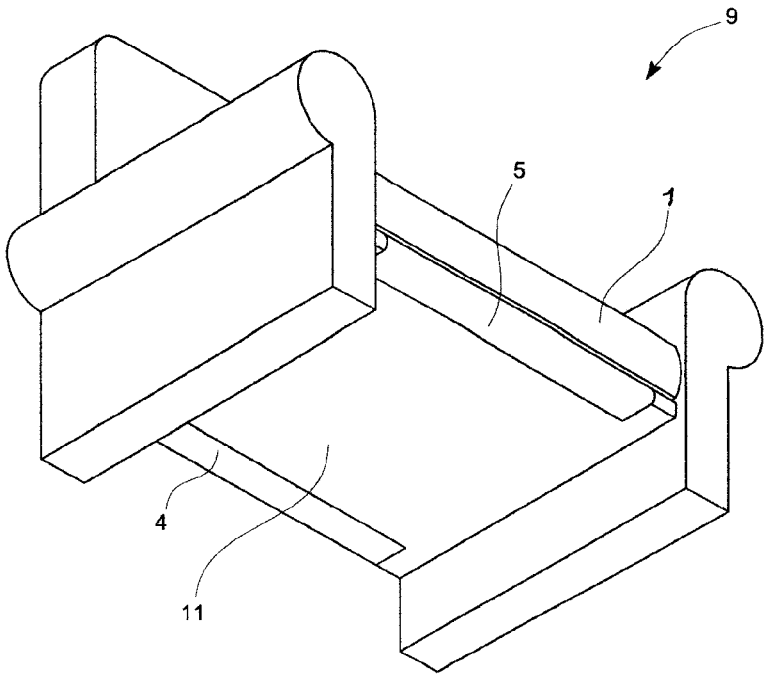
FIG. 4 is an axonometric bottom view of a recliner in accordance with the present invention.

FIG. 3 and FIG. 4 illustrate the removable seat cushion 1 as it would normally be positioned with other portions of a recliner 9. In FIG. 3 and FIG. 4, the removable seat cushion is positioned so that the cushion 1 rests on top of the seat box 11 and in front of the seat back 10. The front flap 5 would extend over and around the seat box 11, and the rear flap 4 would also extend over and around the seat box 11. The seat box is generally considered to be part of the frame of a reclining seat; however, it is possible that, in some methods of recliner manufacture, the seat box may not be a fully-integrated portion of the frame of the reclining seat.

Figure 5:
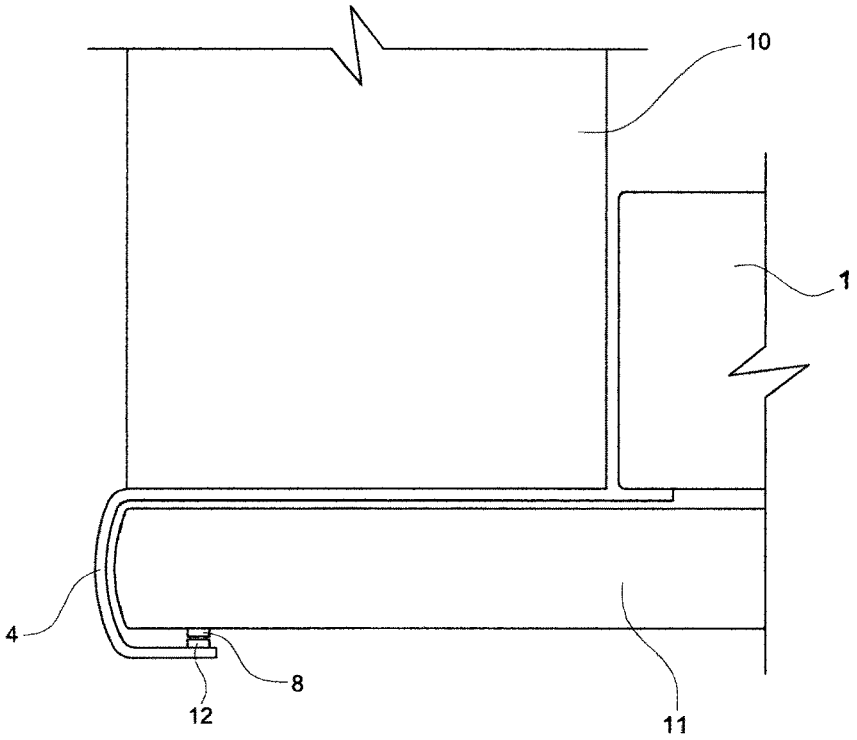
FIG. 5 is a cross-side view of the back portion of a recliner seat cushion in accordance with the present invention.
Figure 6:
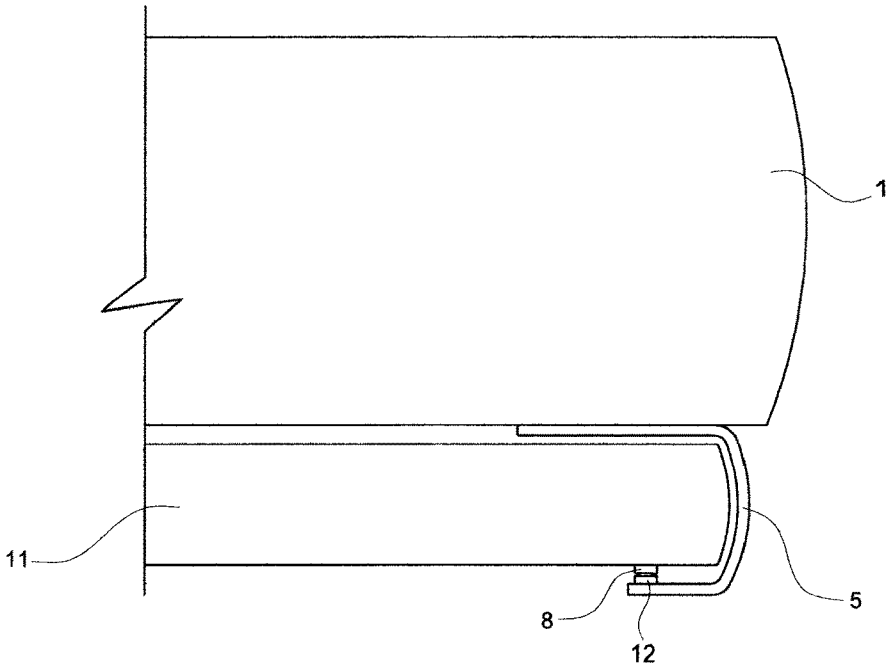
FIG. 6 is a cross-side view of the front portion of a recliner seat cushion in accordance with the present invention.

FIGS. 5 and 6 illustrate an embodiment for attaching the removable seat cushion 1 to the recliner, with FIG. 5 reflecting the rear portion of the removable seat cushion and FIG. 6 reflecting the front portion of the removable seat cushion. In FIG. 5, the rear flap 4 is attached to the seat box 11 by a strip of loop 8 and a strip of hook 12; this rear flap 4 would be pulled under the seat back 10 and would wrap around the rear portion of the seat box 11. In FIG. 6, the front flap 5 is also attached to the seat box 11 via a strip of loop 8 and a strip of hook 12.

While various inventive aspects and features of the general inventive concepts are described and illustrated herein in the context of various exemplary embodiments, these various aspects and features may be used in many alternative embodiments, either individually or in various combinations and sub-combinations thereof. Unless expressly excluded herein all such combinations and sub-combinations are intended to be within the scope of the general inventive concepts. Still further, while various alternative embodiments as to the various aspects, concepts and features of the inventions (such as alternative materials, structures, configurations, methods, devices and components) may be described herein, such descriptions are not intended to be a complete or exhaustive list of available alternative embodiments, Whether presently known or later developed. Those skilled in the art may readily adopt one or more of the inventive aspects, concepts or features into additional embodiments and uses within the scope of the general inventive concepts even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Descriptions of exemplary methods or processes are not limited to inclusion of all steps as being required in all cases, nor is the order that the steps are presented to be construed as required or necessary unless expressly so stated.

What is claimed is:

1. A removable seat cushion for a recliner comprising:
- a cushion;
- a rear flap which has at least two side edges and one edge that is not adjacent to the cushion and which is adapted to be wrapped under a seat back and around a back portion of a seat box of the recliner;
- a front flap which has at least two side edges and one edge that is not adjacent to the cushion;
- one portion of a hook and loop fastener which is attached to the rear flap and which is adapted to be attached to another portion of a hook and loop fastener that is attached to a bottom portion of the seat box of the recliner; and
- one portion of a hook and loop fastener which is attached to the front flap and which is adapted to be attached to another portion of a hook and loop fastener that is attached to the bottom portion of the seat box of the recliner.

2. A removable seat cushion for a recliner according to claim 1, wherein at least one of the flaps includes one portion of a hook and loop fastener which is affixed to an edge of such flap that is not adjacent to the cushion.

3. A removable seat cushion for a recliner according to claim 1, wherein the removable seat cushion further comprises:
- a core insert;
- a core insert cover; and
- an opening in the core insert cover that permits the core insert to be removed from the core insert cover.

4. A removable seat cushion for a recliner according to claim 3, wherein at least one of the flaps includes one portion of a hook and loop fastener.

5. A removable seat cushion for a recliner according to claim 3, wherein the opening in the core insert cover consists of a zipper.

6. A removable seat cushion for a recliner according to claim 3, wherein the opening in the core insert cover includes at least one button.

7. A removable seat cushion for a recliner according to claim 3, wherein the opening in the core insert cover includes at least one snap.

8. A method of attaching a removable seat cushion of claim 1 to a recliner, the method comprising:
- (a) placing the seat cushion on top of the seat box of the recliner;

(b) pulling the rear flap of the seat cushion under a seat back of the recliner;

(c) wrapping said rear flap of the seat cushion around the back portion of the seat box of the recliner;

(d) attaching said rear flap of the seat cushion to a portion of a hook and loon fastener which is attached to the bottom portion of the seat box of the recliner;

(e) wrapping a front flap of the seat cushion around a front portion of the seat box of the recliner; and (f) attaching said front flap of the seat cushion to a portion of a hook and loop fastener which is attached to the bottom portion of the seat box of the recliner.

9. A method of attaching a removable seat cushion according to claim 8 to a recliner wherein the means for attaching the rear flap to the seat box of the recliner is via a hook-and-loop fastener.

10. A method of attaching a removable seat cushion according to claim 8 to a recliner wherein the means for attaching the front flap to the seat box of the recliner is via a hook-and-loop fastener.

* * * * *